US008550775B2

(12) United States Patent
Chen

(10) Patent No.: US 8,550,775 B2
(45) Date of Patent: Oct. 8, 2013

(54) COMPRESSOR

(75) Inventor: Hua Chen, Blackburn (GB)

(73) Assignee: Honeywell International Inc., Morristown, NJ (US)

( * ) Notice: Subject to any disclaimer, the term of this patent is extended or adjusted under 35 U.S.C. 154(b) by 1517 days.

(21) Appl. No.: 10/552,376

(22) PCT Filed: Aug. 13, 2002

(86) PCT No.: PCT/GB02/03779

§ 371 (c)(1),
(2), (4) Date: Oct. 7, 2005

(87) PCT Pub. No.: WO2004/015276

PCT Pub. Date: Feb. 19, 2004

(65) Prior Publication Data

US 2006/0275113 A1 Dec. 7, 2006

(51) Int. Cl.
*F04D 29/68* (2006.01)

(52) U.S. Cl.
USPC ..... 415/173.1; 415/119; 415/914

(58) Field of Classification Search
USPC ..... 415/119, 173.1, 173.5, 208.3, 208.4, 415/211.1, 211.2, 224.5, 914
See application file for complete search history.

(56) References Cited

U.S. PATENT DOCUMENTS

| | | | | |
|---|---|---|---|---|
| 2,471,174 | A * | 5/1949 | Trumpler | 415/224.5 |
| 3,824,029 | A * | 7/1974 | Fabri et al. | 415/224.5 |
| 3,893,787 | A * | 7/1975 | Jones | 415/173.5 |
| 4,315,714 | A | 2/1982 | Exley et al. | |
| 4,395,197 | A * | 7/1983 | Yoshinaga et al. | 415/208.3 |
| 4,460,309 | A | 7/1984 | Walsh | |
| 4,645,419 | A * | 2/1987 | Furuya et al. | 415/208.2 |
| 4,930,979 | A | 6/1990 | Fisher et al. | |
| 5,246,335 | A * | 9/1993 | Mitsubori et al. | 415/914 |

FOREIGN PATENT DOCUMENTS

| | | | |
|---|---|---|---|
| EP | 1126133 | | 8/2001 |
| GB | 636290 | A * | 4/1950 |
| GB | 2034435 | | 6/1980 |
| JP | 2-78788 | A * | 3/1990 |
| JP | 5-106598 | A * | 4/1993 |
| WO | WO02/44527 | | 6/2002 |
| WO | PCT/GB02/03779 | | 10/2002 |

* cited by examiner

*Primary Examiner* — Christopher Verdier

(57) ABSTRACT

A compressor for a turbocharger having a compressor wheel with compressor blades, and being mounted for rotation on a shaft. The compressor has a shroud mounted adjacent the wheel and defining a gas flow path between the shroud and the blades from a compressor inlet to a diffuser outlet. In cross-section the shroud has a surface in the flow path, the surface having a profile that includes a section with a smoothly curving surface and at least one relative discontinuity forming a downstream-facing face.

13 Claims, 4 Drawing Sheets

COMPRESSOR

BACKGROUND OF THE INVENTION

1. Field of the Invention

The present invention relates to compressors and has particular application in centrifugal compressors used in automotive turbochargers to improve fuel economy and reduce noxious emissions.

2. Description of the Related Art

An automotive turbocharger is described in the applicant's own prior publication WO02/44527. This comprises a turbine wheel, driven by exhaust gases from an internal combustion engine, turning a shaft on which is mounted a compressor wheel. The compressor wheel delivers compressed air to the engine, via a diffuser section, thus supplying air to the engine at a higher than normal rate to increase the engine efficiency and performance.

The component parts are mounted in a housing comprising a shroud around the compressor wheel. To maximise efficiency the shroud fits closely around the wheel and has a smooth profile following the shape of the wheel, from the air intake, over the wheel blades and past the wheel tip so that air flows smoothly into the diffuser part of the compressor.

A clearance must be provided between the shroud and the wheel to allow the wheel to spin freely. This clearance is kept to a minimum because it tends to allow a reverse flow of air from the diffuser back to the air inlet for the compressor wheel particularly when the compressor operates close to maximum. This is undesirable because it reduces the compressor efficiency, and increases compressor surge flow and noise.

The present invention has the advantage of reducing reverse flow, improving compressor efficiency and reducing noise.

According to the present invention there is provided a compressor comprising: a compressor wheel having compressor blades and being mounted for rotation on a shaft, a shroud mounted adjacent the wheel and defining a gas flow path between the shroud and the blades from a compressor inlet to a diffuser outlet; wherein in cross-section the shroud has a surface in the flow path with a profile which includes a section with a smoothly curving surface and at least one relative discontinuity.

Such a compressor may be used in a turbocharger.

The discontinuity may comprise at least one relatively abrupt edge (compared to the gradient of the curving surface) or may comprise a step or cut-out or groove in the surface. For example a single planar surface may be cut into the curving surface either parallel to the axis of the shaft or perpendicular to it or at another angle. The curving section may be machined to join smoothly with the planar surface at each of its ends.

Alternatively a step may be machined out of the curving surface by cutting two planar surfaces, a first one parallel to the shaft axis and a second one perpendicular thereto, or at different angles.

Advantageously the discontinuity is formed by machining in the same operation which forms the rest of the compressor housing.

According to a preferred embodiment the discontinuity is located at a predetermined radius from the shaft which radius is larger than the radius of the wheel.

According to a particularly preferred embodiment the radial distance between the discontinuity and the wheel tip is of the same approximate order as the radial clearance between the wheel and the housing at the wheel leading edge.

According to a second embodiment of the invention a second discontinuity is provided in the region of the leading edge of the wheel. The second discontinuity may take any of the forms described for the first discontinuity, ie be a step, cut-out or groove in the smoothly curving surface of the shroud.

Preferably the second discontinuity lies just upstream of the leading edge of the wheel blades, advantageously spaced therefrom by a distance of the same order as the axial clearance of the wheel tip from the compressor housing.

The radial extent of the second discontinuity may preferably be of the same order as the radial clearance between the wheel inducer tip, or leading edge tip, and the housing. The sizes and shapes of the two discontinuities may be made closely similar or identical.

A compressor according to the present invention can be assembled in the traditional way and thus no additional assembly costs are incurred.

A compressor according to the invention is found to add a greater resistance to, thus reducing the strength of, the reverse flow, and to be more efficient.

For a better understanding of the present invention, and to show how the same may be carried into effect, reference will now be made to the accompanying drawings, in which.

FIGS. 4*a* to 4*h* illustrate various possible shapes in cross-section for part of the shroud of any of the above figures.

Figure 1:
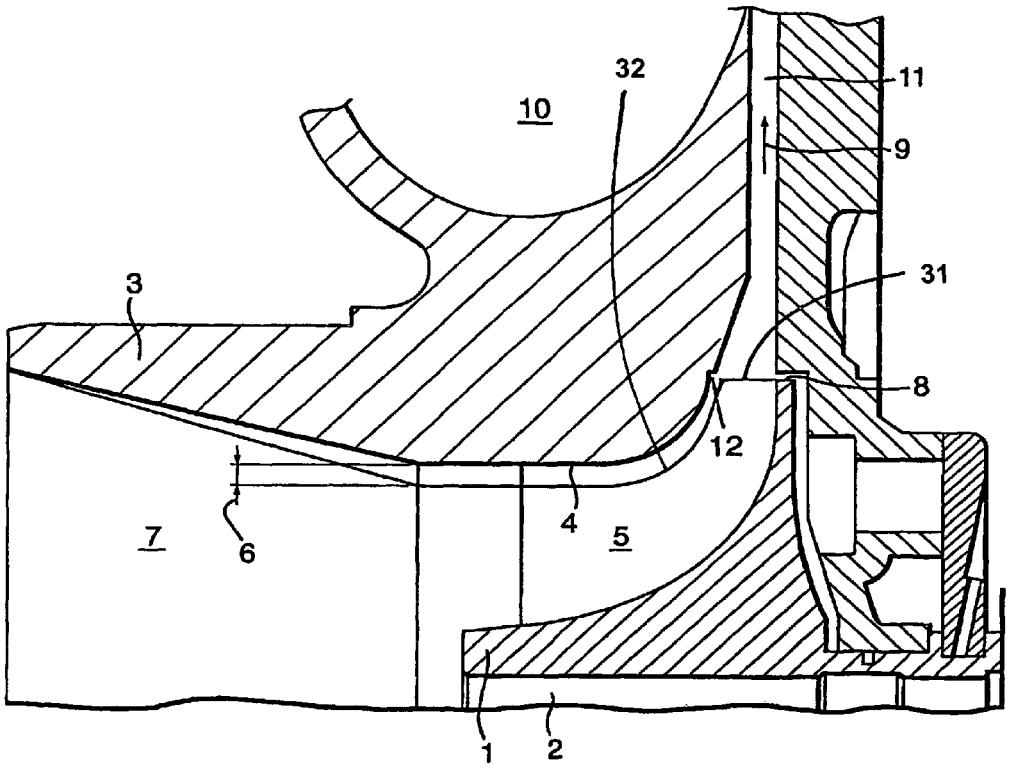
FIG. 1 is a cross sectional view of part of a compressor illustrating the shape of a compressor shroud according to one embodiment of the present invention.

In FIG. 1 a compressor wheel comprises a hub 1, tapering to a tip 8, at the trailing edge 31, and attached to free-ended blades of which the radial extent is indicated at 5 along a free-ended outer edge 32 and the trailing edge 31. The wheel is mounted for rotation on a shaft 2 within a compressor housing 3. The wall of the housing 3 forms a shroud 4 spaced from the blades 5 of the wheel by a clearance distance 6.

An air inlet 7 allows entry of air to the wheel which compresses it and the compressed air exits the wheel along diffuser passageway 11 past the tip 8 of the wheel in the direction of arrow 9 to a volute diffuser 10 from where it is subsequently supplied to an engine (not shown).

The wall of the housing 3 which forms the shroud 4 is traditionally a smoothly curved surface as it passes the wheel. However in this invention the shroud 4 has a discontinuity, ie is stepped. Thus, as can be seen more clearly in FIG. 2, a small cut-out 12 is moulded, cast, or machined in the wall in the region of the wheel tip 8. The cut-out 12 has at least one relatively sharp corner 13 and in this embodiment has a second sharp corner 14 and a straight portion 15 extending generally parallel to the shaft 2.

Between the cut-out 12 and the wheel tip 8 is a radial clearance distance 16 which is of the same order as the radial distance 6 between the wheel and the housing 3 at the wheel leading edge.

The cut-out 12 has an axial length 17 which is of the same order as the axial clearance between the wheel and the housing 3 at the wheel trailing edge.

Figure 2:
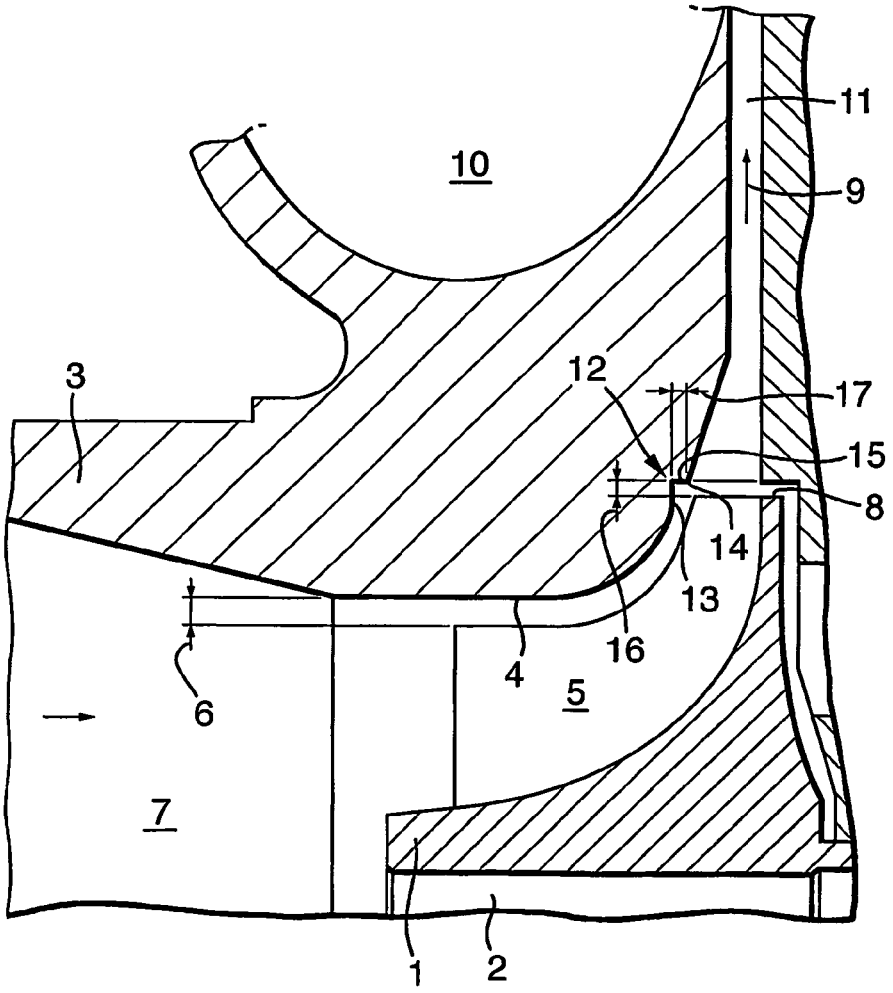
FIG. 2 is a close up cross sectional sketch of part of the compressor shroud of FIG. 1 with some features exaggerated in dimension to more clearly illustrate the invention.
Figure 3:
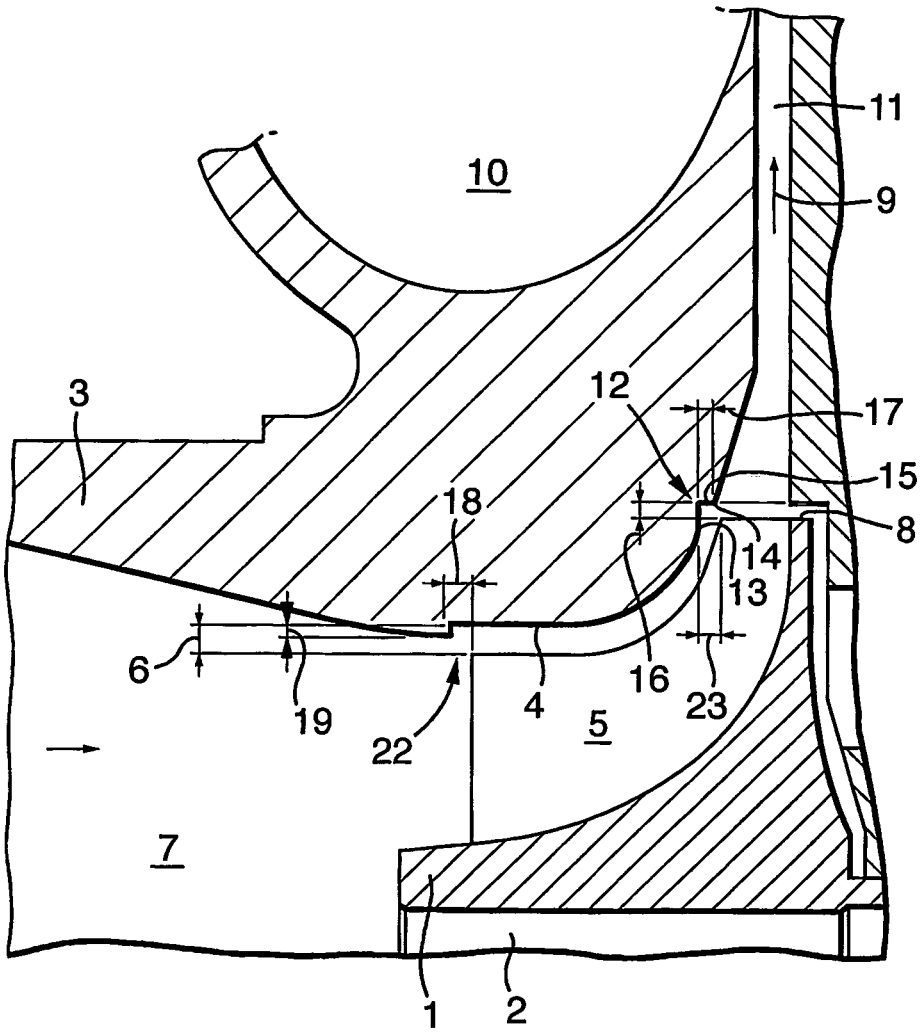
FIG. 3 is a close up cross-sectional view of part of the compressor shroud according to a second embodiment of the present invention again with some features exaggerated in dimension.

The dimensions of the cut-out 12 are exaggerated in FIGS. 2 and 3 to more clearly illustrate the invention. The true intended proportions are more accurately illustrated in FIG.

1. For example, a compressor having an air inlet 7 of approximately 38 mm with a wheel exducer tip 8 of approximately 52 mm, might typically have a wheel tip to housing clearance of 0.50 mm and radial clearance 6 of 0.3 mm and a cut-out 12 with radial clearance distance 16 of also about 0.30 to 0.50 mm. The axial overlap of the cut-out 12 with the blades 5 might typically be as small as 0.16 mm.

This cut-out 12 can relatively easily be machined with the rest of the housing contour, for example by NC (Numerical Controlled) machining. There would be very minimal additional cost involved if any.

In FIG. 3 a preferred embodiment of the invention is shown in which a second step 22 is provided in the region of the leading edge of the wheel and blades 5, preferably just upstream of the blade edge and spaced therefrom by a distance 18 which is approximately the same as the wheel-housing axial clearance 23 at the impeller trailing edge, i.e., the wheel tip 8 (this is the distance between the housing shroud and the wheel shroud which allows some slight axial movement of the wheel as it spins). The second step 22 has a radial height 19 which is of the same order or approximately equal to the wheel-housing radial clearance 6 at the impeller leading edge 8. Thus the radial heights 16, 19 of each step 12, 22 are approximately the same and are equal to the wheel housing radial clearance 6.

The step or steps in the shroud contour present relatively sharp edges to any reverse flow of air from the diffuser 10 to the air entrance 7. This provides a resistance or blockage to reverse flow, forcing it to go through the impeller blade channel. The reverse flow is thus weakened and its effects reduced. Use of the present invention can reduce noise levels in a turbocharger and increase efficiency.

FIGS. 4*a* to 4*h* illustrate eight possible shapes for the cross-sectional contour of the shroud 4 of the housing 3, in the region of the discontinuity or step 12. Many other possibilities will be evident to a person skilled in the art.

Figure 4A:
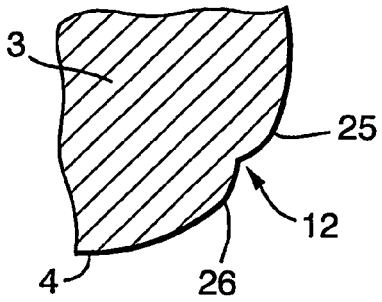
Figure 4B:
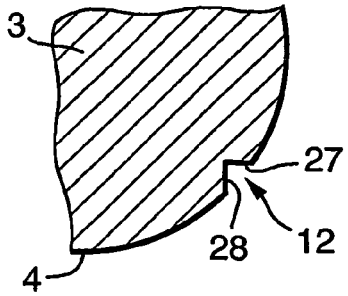
Figure 4C:
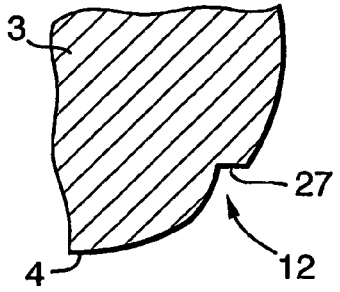
Figure 4D:
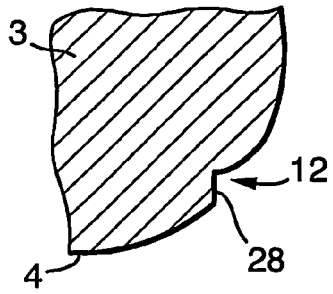
Figure 4E:
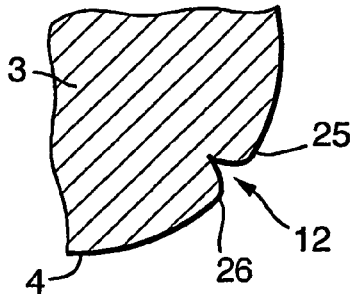
Figure 4F:
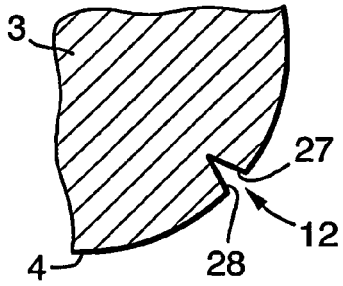

In FIGS. 4*a* and 4*e* the discontinuity 12 is formed at the single point junction of two curving sections 25, 26. In FIG. 4*a* the two curving sections 25, 26 join at an obtuse angle and in FIG. 4*e* they join at an acute angle.

In FIG. 4*b* two planar surfaces are cut into the curved shroud surface 4, a first planar surface 27 parallel to the shaft axis, and a second planar surface 28 perpendicular to the shaft axis, so that they meet at right angles. The orientations of the planar surfaces may be different so that they meet at either obtuse or acute angles, as for example in FIG. 4*f* where the planar surfaces 27 and 28 meet at an acute angle.

In FIG. 4*c* a single planar surface 27 parallel to the shaft axis is cut and on one side the curved surface 4 is machined to curve at a steeper angle to meet the planar surface 27.

Likewise in FIG. 4*d* where the single planar surface 28 is machined parallel to the wheel radius.

Figure 4G:
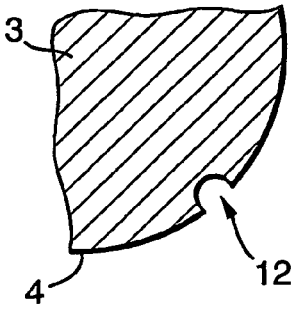
Figure 4H:
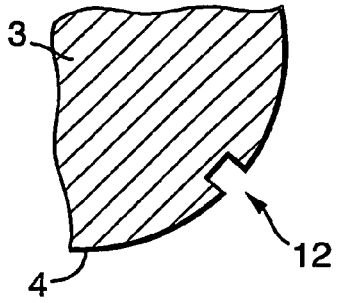

In FIGS. 4*g* and 4*h* the discontinuity 12 is in the form of a groove. In FIG. 4*g* this is a groove with curved sides, essentially a semicircular cross-section. In FIG. 4*h* the groove has straight sides, ie a rectangular cross-section.

Any of these shapes, as illustrated in FIGS. 4*a* to 4*h* may be used for either or both of the discontinuities discussed.

The shape and size of the or each discontinuity or step 12 will be determined by the operating parameters and mechanical structure of the compressor. For example if the compressor is intended to operate close to its surge line, then the or each step may be made deeper and/or the angle of the discontinuity made larger.

More than one step in each or either of the leading and trailing edges may also be advantageous.

The invention claimed is:

1. A compressor comprising:

a compressor wheel having a hub, free-ended compressor blades and being mounted for rotation on a shaft, each blade being characterized by a free-ended outer edge, an upstream leading edge and a downstream trailing edge; and a shroud mounted around the outer edges of the compressor blades and defining a gas flow path between the shroud and the hub from a compressor inlet to a diffuser outlet, through which the blades rotate with respect to the shroud;

wherein in cross-section the shroud forms a surface along the flow path, the surface being characterized by a profile that includes a relative discontinuity in the region of the trailing edge; and wherein the discontinuity forms a downstream-facing blocking face adapted to impede an upstream flow of gas between the shroud and the wheel, the blocking face extending across the gas flow path to form a sharp edge connecting the blocking face to a smoothly curving surface along the gas flow path upstream of the blocking face.

2. A compressor according to claim 1, wherein the cross-section profile of the shroud surface along the flow path is further characterized by a second relative discontinuity that is in the region of the leading edge, and wherein the second relative discontinuity forms a second-discontinuity downstream-facing blocking face adapted to impede an upstream flow of gas between the shroud and the wheel, the second-discontinuity blocking face extending across the flow path to form a second-discontinuity sharp edge connecting the second blocking face to a second-discontinuity smooth surface upstream of the second discontinuity blocking face.

3. A compressor according to claim 2 wherein the second discontinuity is located upstream of the leading edge of the wheel blades.

4. A compressor according to claim 3 wherein the second discontinuity is spaced from the leading edge of the wheel blades by a distance of the same order as the axial clearance of the trailing edge from the compressor housing.

5. A compressor according to claim 2, wherein each downstream-facing blocking face comprises a planar surface cut into the curving surface.

6. A compressor according to claim 2, wherein the second-discontinuity downstream-facing blocking face comprises a planar surface cut into the curving surface, and wherein the planar surface is perpendicular to the axis of the shaft.

7. A compressor according to any one of claim 2, 4, or 5, wherein the radial extent of the second discontinuity is of the same order as the radial clearance between the trailing edge and the housing.

8. A compressor according to any one of claim 2, 4, or 5, wherein the sizes of the first and second discontinuities are closely similar.

9. A compressor according to any one of claim 2, 4 or 5, wherein the shapes of the first and second discontinuities are closely similar.

10. A turbocharger comprising a compressor according to any one of claim 1, 2, 4 or 6.

11. A compressor according to claim 1, wherein the blocking face forms a second sharp edge on an opposite side of the blocking face from the first sharp edge, the second sharp edge connecting the blocking face to a second smoothly curving surface that is downstream of the blocking face.

12. A compressor according to claim 2, wherein the first-discontinuity blocking face forms a second sharp edge on an opposite side of the first-discontinuity blocking face from the first sharp edge of the first-discontinuity blocking face, the second sharp edge connecting the first-discontinuity blocking face to a second first-discontinuity smoothly curving surface downstream of the first-discontinuity blocking face.

13. A turbocharger according to claim 1, wherein the discontinuity is in the form of a groove.

* * * * *